United States Patent [19]

Gressett, Jr.

[11] Patent Number: 4,557,174

[45] Date of Patent: Dec. 10, 1985

[54] GUITAR NECK INCORPORATING DOUBLE-ACTION TRUSS ROD APPARATUS

[75] Inventor: Charles A. Gressett, Jr., Brea, Calif.

[73] Assignee: Fender Musical Instruments Corporation, Brea, Calif.

[21] Appl. No.: 492,260

[22] Filed: May 6, 1983

[51] Int. Cl.[4] ..... G10D 3/00

[52] U.S. Cl. ..... 84/293

[58] Field of Search ..... 84/293

[56] References Cited

U.S. PATENT DOCUMENTS

| | | | |
|---|---|---|---|
| 516,717 | 3/1894 | Anderberg . | |
| 1,446,758 | 2/1923 | McHugh . | |
| 2,056,474 | 10/1936 | Low | 84/293 |
| 2,100,249 | 11/1937 | Hart | 84/293 |
| 2,101,364 | 12/1937 | Dopyera | 84/293 |
| 2,148,589 | 2/1939 | Stathopoulo | 84/293 |
| 2,335,244 | 11/1943 | Gugino | 84/293 |
| 2,460,943 | 2/1949 | Nelson | 84/293 |
| 2,478,136 | 8/1949 | Stromberg | 84/293 |
| 2,510,775 | 6/1950 | Forcillo | 84/293 |
| 2,998,742 | 9/1961 | Pratt | 84/267 |
| 3,143,028 | 8/1964 | Fender | 84/293 |
| 3,159,072 | 12/1964 | Burns et al. | 84/293 |
| 3,244,054 | 4/1966 | Berglund | 84/293 |
| 3,416,399 | 12/1968 | Baldoni | 84/293 |
| 3,535,975 | 10/1970 | Broussard | 84/293 |
| 3,901,119 | 8/1975 | Siminoff | 84/293 |
| 4,074,606 | 2/1978 | Fender | 84/293 |
| 4,084,476 | 4/1978 | Rickard | 84/293 |
| 4,167,133 | 9/1979 | Adams, Jr. | 84/293 |
| 4,192,213 | 3/1980 | Steinberger | 84/293 |
| 4,200,023 | 4/1980 | Kaman | 84/293 |
| 4,203,342 | 5/1980 | Montgomery et al. | 84/293 |
| 4,235,145 | 11/1980 | Adams, Jr. | 84/293 |
| 4,237,944 | 12/1980 | Todd, III et al. | 144/316 |

*Primary Examiner*—L. T. Hix
*Assistant Examiner*—Douglas S. Lee
*Attorney, Agent, or Firm*—Gausewitz, Carr & Rothenberg

[57] ABSTRACT

A guitar neck incorporating truss rod apparatus, in which a bowed truss rod sufficiently strong and rigid to withstand large compressive and tensile stresses is inserted through an anchor affixed centrally of the neck. One end of the truss rod is clamped for prevention of rotational or axial movement. The other end of the truss rod is threaded into an elongated adjustment nut the inner end of which bears against a shoulder in the neck body, and the outer end of which bears against a stop block located below and concealed by the topnut of the neck. The stop block is apertured to permit entrance of a wrench to adjust the nut, and thus effect either compressive or tensile loading of the truss rod for flexing of the neck in either direction. The means for securing the anchor are concealed below one of the face dots present on the finger board of the guitar neck.

17 Claims, 7 Drawing Figures

FIG. 4.
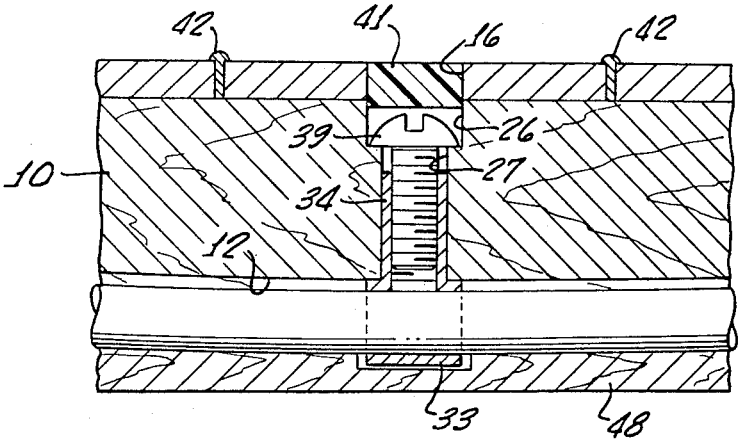
FIG. 3.
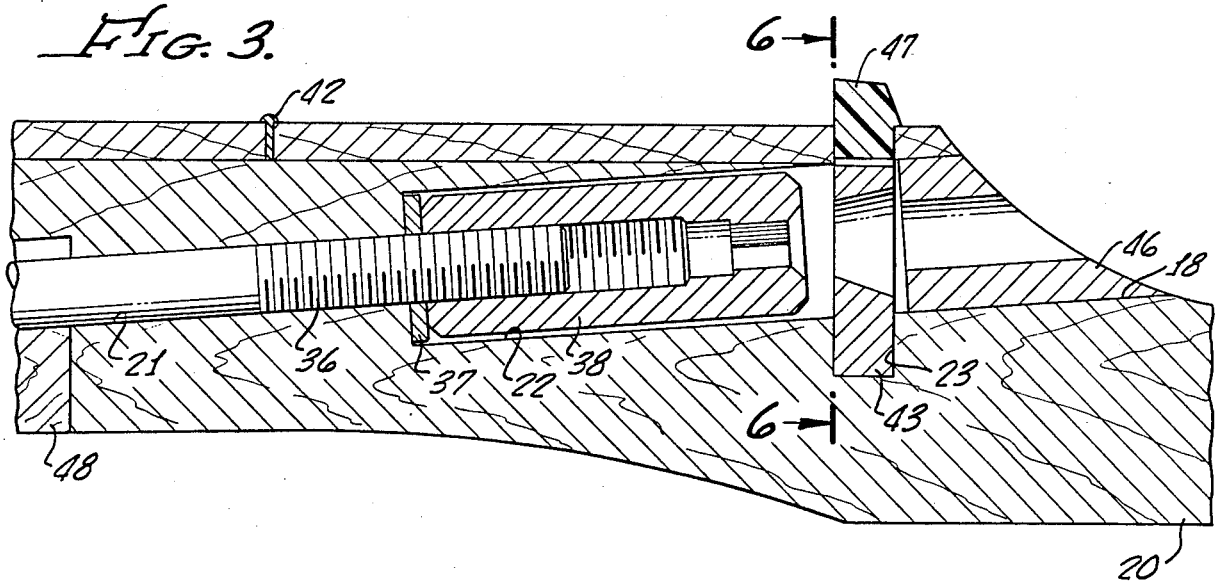
FIG. 6.
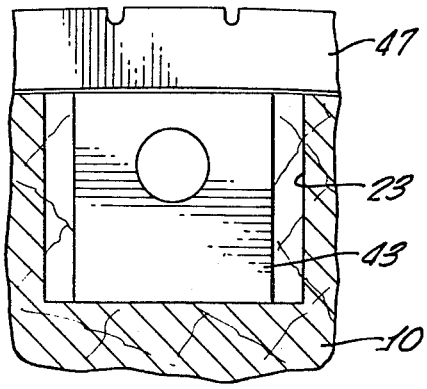
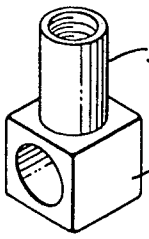
FIG. 7.

GUITAR NECK INCORPORATING DOUBLE-ACTION TRUSS ROD APPARATUS

BACKROUND OF THE INVENTION

It has long been known that it would be highly desirable to manufacture a practical and aesthetically-satisfactory guitar neck incorporating a truss rod assembly which can be operated to bow the neck either upwardly or downwardly. In the factory, such a truss rod apparatus would reduce greatly the number of reject necks, namely those necks which have such a bend that it cannot be corrected by conventionally-manufactured truss rods. It is emphasized that the manufacture of high-quality guitar necks is a precision operation, and that the necks are subject to variations not only in the character of the wood, but because of effects resulting from humidity, aging, gluing operations, etc.

In the field, after the guitar has been manufactured and purchased by a musician, it is also very desirable that the neck be capable of being bowed in either direction. Guitarists employ different gauges of strings, and these strings, when tuned to the proper pitches, exert different amounts of compressive forces on the necks. The different compressive forces create different bowing tendencies. For example, a neck which is fully satisfactory relative to heavy-gauge strings may be relatively unplayable when light-gauge strings are used. As is well known, the curvature of the neck is of crucial importance to any guitarist because it is one of the major factors determining the spacing between the frets and strings. When the spacing is too great, the pressing of a string against a fret not only requires excessive force, but tends to make the string become out of tune. When, on the other hand, the spacing between the strings and the frets is too small, there may be rattling of the strings against the frets after plucking has occurred.

Despite the above-indicated major need, it is conventional practice in the guitar industry to manufacture guitar necks incorporating truss rods which bow the guitar necks in only one direction, namely upwardly (make them upwardly convex). The upward bowing is effected by creating increased tension in a downwardly-bowed truss rod incorporated in the neck, such increased tension being for the purpose of counteracting the tendency toward downward bowing of the neck resulting from the tension of the strings. Previous attempts to achieve neck bowing in both directions have been impractical and otherwise unsatisfactory for various reasons.

SUMMARY OF THE INVENTION

It has now been discovered that a commercially satisfactory, precision-operation, aesthetically beautiful guitar neck may be manufactured with a double-acting truss rod assembly, thus not only reducing greatly the number of reject necks at the factory, but giving the musician a long-wanted capability relative to adjustment of the spacing between frets and strings.

According to one major aspect of the invention, a truss rod having sufficient diameter and strength to transmit large tensile and compressive forces is mounted in the neck in bowed relationship. One end of the truss rod is locked against rotational or axial movement, while the other end of the truss rod is threaded axially into an adjustment nut. The inner end of such nut seats adjacent an end of a bore in the neck, while the outer end seats adjacent a stop block inserted transversely into the neck. The nut is provided with means, at its outer end, adapted to be nonrotatably engaged by a wrench oriented axially of the nut. The neck and stop block are apertured, also axially of the nut, in order that the nut may be rotated to effect bowing of the neck in either direction. In the preferred embodiment, the stop block is disposed beneath and concealed by the permanently-mounted topnut.

In accordance with another major aspect of the invention, the above-indicated truss rod having sufficient strength and rigidity to transmit large axial forces (both compressive and tensile) is seated slidably in an anchor element disposed at a mid-region of the neck. The anchor element is, in turn, secured to the neck so that it may not move laterally regardless of the forces exerted by the rod.

BRIEF DESCRIPTION OF THE DRAWINGS

FIG. 3 is an enlarged view of elements at the right end of FIG. 1;

FIG. 4 is an enlarged view of elements shown at the central region of FIG. 1;

FIG. 6 is a fragmentary transverse section on line 6—6 at FIG. 3; and FIG. 7 is an isometric view of the anchor.

DETAILED DESCRIPTION OF THE PREFERRED EMBODIMENT

The present invention is applicable to both Spanish and bass guitars, whether electric or acoustic.

Figure 2:
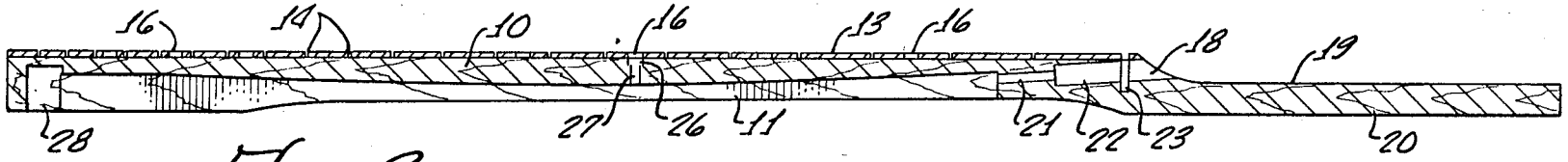
FIG. 2 is a view corresponding to FIG. 1, but illustrating only the main wooden body (and fingerboard) of the neck.

Referring to FIG. 2, the main body of the neck is numbered 10 and has milled, in the underside thereof, the usual longitudinal groove 11 which preferably has a curved upper wall 12 (such wall 12 being downwardly concave). Glued on the upper side of body 10 is the fingerboard 13. The fingerboard is transversely grooved at 14 to receive the frets, and also has a plurality of holes 16 each adapted to receive a position-indicating plug called a "face dot" and which indicates to the guitarist where his fingers are in relation to the frets. At the outer end of fingerboard 13 is a transverse groove 17 (FIGS. 2 and 5) adapted to receive the topnut over which the guitar strings are to be extended.

Starting at a region to the right of groove 17 in FIG. 2, the upper surface of the neck curves downwardly at 18 so as to merge with the upper surface 19 of the peghead 20 of the guitar.

A plurality of differently-sized coaxial bores 21 and 22 are bored and counterbored through neck body 10 at a small angle to a horizontal plane containing the longitudinal axis of the neck. The preferred angle is about 4 degrees from the horizontal, and the direction of inclination is upward as the peghead is approached. The inclination permits straight-line tensioning or compressing of the truss rod, and greatly facilitates assembly.

The bores 21, 22 communicate coaxially with each other, and extend from the extreme right end of groove 11 (FIG. 2) to the downwardly-curved region 18 between the fingerboard and the head surface 19. Bore 21 is relatively adjacent groove 11, and communicates with it, being sufficiently large to receive the truss rod. Bore 22 is much larger in diameter than is bore 21.

Figure 5:
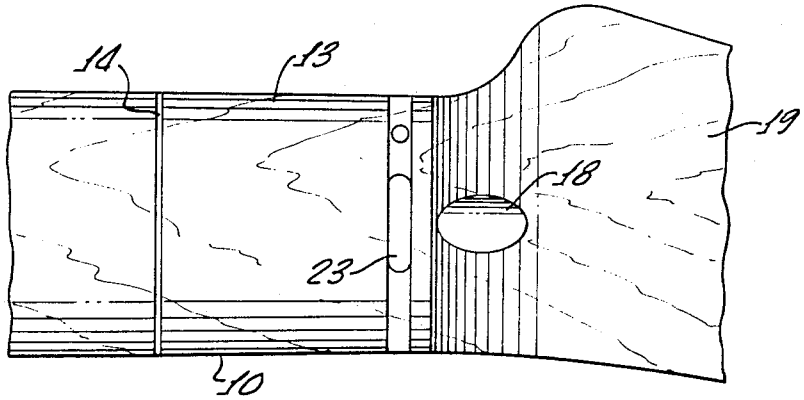
FIG. 5 is a top plan view of a right region of the showing of FIG. 2.

Referring to FIGS. 2 and 5, a relatively deep but narrow recess 23 intersects the large bore 22. The recess 23 is shown as lying generally in a plane perpendicular to the fingerboard, and directly beneath—and communicating with—the transverse groove 17 for the topnut. Recess 23 is present in only the central region of groove 17.

Referring next to the central region of FIG. 2, the hole 16 for one of the centrally-located face dots (at a region generally midway between the opposite ends of the neck) is deepened by drilling to form a cylindrical recess 26 which extends downwardly a substantial distance below fingerboard 13. Furthermore, a vertical bore 27, coaxial with recess 26 and having a much smaller diameter, is extended downwardly from the bottom of recess 26 into the groove 11.

At the left end of FIG. 2 there is shown a large-diameter vertical bore 28 which extends upwardly from the bottom surface of body 10, and communicates with the left end of groove 11.

It is to be understood that the groove 11, and the axes of all of bores 21, 22, 27, and 28, lie in a vertical plane containing the longitudinal axis of the neck. (This assumes, as do all statements regarding "horizontal" or "vertical", that the neck is disposed as shown, with the fingerboard substantially horizontal.)

A large cylindrical retaining nut 31 is threadedly connected to the threaded left end of a bowed metal truss rod 32 the diameter of which is sufficiently great that it will transmit large compressive, as well as tensile, forces. Thereafter, the retaining nut 31 and truss rod 32 are firmly locked to each other so as to prevent any further rotational movement, a preferred manner of achieving such result being by staking.

The pre-assembled retaining nut 31 and truss rod 32 are then inserted into a strong cylindrical sleeve 33 which functions as an anchor. Preferably, sleeve 33 is a drilled steel cube, the hole therethrough being just sufficiently large to slidably receive the truss rod 32. A shank 34 extends outwardly from one face of the cube and is bored and internally threaded.

THE ELEMENTS AT THE NECK END REMOTE FROM RETAINING NUT 31, AND METHOD OF MANUFACTURE

Figure 1:
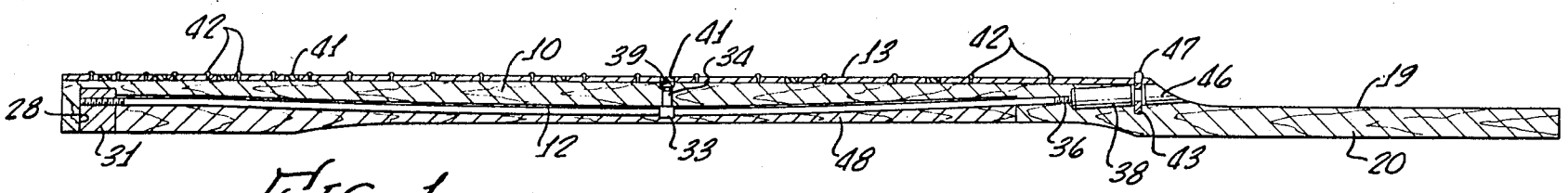
FIG. 1 is a longitudinal vertical sectional view of a guitar neck incorporating the truss rod apparatus of the present invention.

The end portion 36 of truss rod 32, remote from retaining nut 31, is threaded, and is inserted from groove 11 through bores 21 and 22 (toward the right in FIG. 1) until the threaded region 36 is a substantial distance outwardly from (to the right of, and spaced above) curved region 18 of the neck-head junction. Then, a friction-reducing and wear-absorbing washer 37 (formed, for example, of brass) is mounted over the projecting threaded end of the truss rod.

An elongated cylindrical adjustment nut 38 is then threaded coaxially onto end portion 36, but only a relatively short distance. The left and central regions of nut 38 are internally bored and threaded to mate with threaded end 36, while the right (outer) end of the nut (FIG. 3) is noncircularly apertured to receive, nonrotatably and coaxially, a wrench such as a hexagonal or square wrench.

The outer surface of adjustment nut 38 is cylindrical, and has a diameter only slightly smaller than that of the large bore 22 (FIG. 2). The length of nut 38 is only slightly less than the distance between recess 23 and the shoulder formed at the junction between bores 21 and 22.

The assembler then pulls on truss rod 32, toward the left, to cause movement thereof until retaining nut 31 is registered with its bore 28. Such movement causes washer 37 and nut 38 to enter bore 22. Furthermore, the assembler adjusts the anchor (sleeve 33 and its associated shank 34) along the truss rod until the shank is registered with bore 27, and is partially inserted therein, it being understood that such shank is sized to be a relatively close fit (preferably) in the bore 27.

The assembler then effects a force-fit between retaining nut 31 and the wall of bore 28, and shank 34 is caused to penetrate its associated bore 27. A screw 39 (FIG. 4) is then inserted downwardly through dot hole 16 into recess 26 (FIG. 2), and is threaded tightly into shank 34 of the anchor. The head of the screw seats on the shoulder formed at the junction between recess 26 and bore 27, and the shank length of the anchor is such that sleeve 33 is seated on the bottom wall of groove 11.

Face dots 41 (plugs) are pressed into and glued into the various holes 16 therefor, one such face dot 41 hiding the head of screw 39. Furthermore, the frets 42 are pressed into the various slots 14 in the fingerboard.

A wrench is inserted coaxially into bore 22 and employed to turn the adjustment nut 38 in such direction as to cause drawing of such nut into bore 22 until the outer nut end does not block any portion of recess 23.

There is then inserted into recess 23 a stop block 43 (FIG. 3) formed of a strong material such as steel, and sized to fill the entire recess 23 below (but not in) the groove 17 for the topnut. The stop block 43 has an aperture 44 registered with the bore in adjustment nut 38, and with the noncircular nut opening for the wrench, but sufficiently small that the outer end of nut 38 will bear against stop block 43 and may not penetrate the aperture 44.

There is then inserted, into the outer end of large bore 22, a drilled dowel 46 preferably formed of a decorative hardwood. The outer region of the dowel is flush with curved region 18 shown in FIG. 3. The bore in the dowel is just sufficiently large to receive the wrench that turns adjustment nut 38.

The topnut 47 (FIGS. 1 and 3) is then permanently mounted into its groove 17, which effectively and completely conceals from view the stop block 43.

Furthermore, a wooden insert 48, known as the skunk stripe, is glued into neck groove 11 below truss rod 32. Preferably, the upper edge of insert 48 is curved and conforms generally to the curved truss rod 32.

It is emphasized that truss rod 32 is curved continuously and smoothly from the right end (FIG. 1) at least to the left end portion and preferably all the way to nut 31. Thus, the truss rod end 36 and the nut 38 both lie at the same small (preferably 4 degree) angle as bores 21, 22.

OPERATION

Let it be assumed that the neck has been assembled with a guitar body, not shown, and that the guitar strings have been stretched over the body and over the neck, passing across nut 47 to tuning machines (not shown) mounted on peghead 20. Let it further be assumed that the strings have been tuned to approximately the desired pitches.

At the factory, in the field, and at any time during the playing life of the guitar, the bowing of the neck is adjusted in either direction. If the assembler or musician feels that the strings are excessively far from the frets, he inserts an L-shaped wrench through the bore in dowel 46, through stop block 43, and into the opening at the right end of nut 38. At that time, the handle of the L-shaped wrench is generally perpendicular to the axis of the truss rod. The assembler (or musician) then employs the wrench to rotate nut 38 in such direction as to draw the threaded end region 36 of the truss rod into the nut. The inner end of the nut is seated on washer 37, which cooperates with the adjacent shoulder (formed between bores 21 and 22) to create a thrust bearing. As the threaded end of the truss rod is drawn into nut 38, the central region of the truss rod bears upwardly against the upper portion of anchor sleeve 33 and depending upon the curvature of groove wall 12, against certain regions of such groove wall. The result is that the fingerboard 13 moves upwardly until the frets 42 are at the desired spacing from the strings.

It is emphasized that the above adjustment, and the one next described, is made while the guitar strings are in position and tuned.

To cause the fingerboard and frets to be farther from the strings, the assembler or musician reverses the direction of rotation of nut 38. This, at first, relaxes the tension on truss rod 32 until there is no tension. Then, further rotation of nut 38 in the same direction causes the nut to be threaded outwardly (to the right as viewed in FIGS. 1 and 3) until the right end of the nut engages stop block 43. After the stop block is thus engaged, further rotation of nut 38 in the same direction creates bearing engagement between the nut and the stop block and thus causes compressive loading of truss rod 32.

The compressive loading on the truss rod tends to bow it downwardly at the central region, which creates a force against the bottom portion of anchor sleeve 33. This force is transmitted through shank 34 of the sleeve to screw 39, and thus to the shoulder between recess 26 and bore 27. The downward force on such shoulder causes the neck to bow downwardly, there being a little or no pressure exerted on the skunk-stripe insert 48.

During the above-described adjustments of the truss rod, there is some longitudinal movement of the truss rod in anchor sleeve 33, which longitudinal movement is readily effected due to the sliding metal-to-metal relationship between the truss rod and the sleeve 33.

In the described manner, therefore, the desired degree of bowing is achieved at the factory, in either upward or downward direction, which substantially reduces the reject rate of manufactured necks. Later, in the field, the musician can adjust the neck to compensate for different gauges of strings, or for the effects of aging, or weather, to maintain the desired spacing between strings and frets. Very importantly, the present neck and its associated truss rod apparatus are highly decorative and do not depart in any substantial degree from the appearance of the necks to which musicians have long been accustomed.

Furthermore, since the present truss rod apparatus preferably does not protrude at any point, the neck can be buffed and finished (as by polyurethane) after both the truss rod and adjustment nut are in position.

The foregoing detailed description is to be clearly understood as given by way of illustration and example only, the spirit and scope of this invention being limited solely by the appended claims.

What is claimed is:

1. A guitar neck incorporating double-action truss rod apparatus, comprising:

(a) an elongated guitar neck body, (b) an elongated truss rod mounted in said body longitudinally thereof, said truss rod being, at all times, bowed in a single direction and in a plane that is transverse to the upper side of said neck body, said truss rod having strength and rigidity sufficiently high to transmit large compressive and tensile forces, but sufficiently low that said large compressive and tensile forces will change the degree of said bowing in said single direction, (c) anchor means, connected to said neck body, to restrain at least an intermediate region of said truss rod against substantial transverse movement relative to said neck body, whereby said changing in the degree of bowing of said truss rod will effect corresponding bowing of said neck body, (d) means to restrain one end of said truss rod against substantial rotational or longitudinal movement relative to said neck body, (e) an adjustment nut mounted coaxially on the other end of said truss rod and threadedly associated with such other end, and (f) bearing means associated with said nut and responsive to rotation of said nut in opposite directions to apply said large compressive and tensile forces to said truss rod.

2. The invention as stated in claim 1, in which said bearing means (f) comprises first bearing means on the side of said nut relatively adjacent to said one end of said truss rod and adapted to be engaged by said nut to apply tension to said truss rod and thus reduce the degree of bowing thereof, and second bearing means on the side of said nut relatively remote from said one end and adapted to be engaged by said nut to create longitudinal compression in said truss rod and thus increase the degree of bowing thereof, and in which means are provided to permanently said first and second bearing means.

3. A guitar neck incorporating double-action truss rod apparatus, comprising:

(a) a guitar neck body, (b) a bowed truss rod mounted in said neck body in such relationship that increasing and decreasing the amount of bowing of said truss rod changes the spacing between the upper side of said neck body and guitar strings stretched thereabove when the guitar neck is incorporated in a functioning guitar, said truss rod having sufficient strength that it will not collapse, but instead only bow an increased amount, when large compressive loads are applied thereto, at least one end portion of said truss rod being threaded, (c) means to fix the other end of said truss rod in said neck body whereby to prevent substantial rotational and longitudinal movement of such other end relative to said neck body, (d) an elongated nut telescopically mounted coaxially on said one end portion of said truss rod, the length of said nut being sufficient that said nut may be threaded to a position such that the outer end at said nut is spaced a substantial distance away from the extreme end of said one end portion of said truss rod, on the side of said extreme end remote from said other end of said truss rod, (e) first thrust-bearing means disposed to be engaged by said outer end of said nut,
said first thrust-bearing means and said nut being so related as to create a large compressive load in said truss rod when said nut is in said position stated in clause (d),
(f) second thrust-bearing means positioned to be engaged by said nut when said nut is threaded toward said other end of said truss rod,
said second thrust-bearing means and said nut cooperating with each other to create a large tensile stress in said truss rod when said nut is threaded toward said other end thereof,
(g) means on said neck to conceal said nut and said first and second thrust-bearing means, and
(h) means on said nut, at said outer end thereof remote from said other end of said truss rod, to nonrotatably engage a wrench oriented coaxially of said nut and said truss rod.

4. The invention as stated in claim 3, in which said neck body has a bore therein adapted to receive a wrench and permit its engagement with said nonrotatable engagement means (h).

5. The invention as stated in claim 3, in which a truss rod anchor element is mounted at the central region of said truss rod and connected to said neck body, to transmit lateral forces from said truss rod to said neck body.

6. A double-action guitar neck adapted in response to rotation of a single element to be bowed either upwardly or downwardly, comprising:
(a) a guitar neck body,
(b) a single elongated truss rod mounted in said body in bowed condition,
said truss rod lying in a plane containing the axis of said neck body and perpendicular to the fingerboard of the guitar neck,
(c) means to associate said truss rod with said body in such relationship that changing the degree of bowing of said truss rod will flex said body between upwardly-bowed and downwardly-bowed shapes,
said means (c) comprising a strong sleeve mounted around a central region of said truss rod, and further comprising means to anchor said sleeve to said neck body,
(d) an elongated nut coaxially mounted, threadedly and telescopically, on a threaded end portion of said truss rod,
said nut being adapted to change the effective length of said truss rod and to be disposed in such position that the outer end of said nut is located a substantial distance outwardly of the extreme end of said truss rod,
(e) first and second spaced-apart thrust-bearing means mounted to be engaged by said nut,
said first thrust-bearing means being so positioned, and said nut being sufficiently long, that said truss rod will be under compression and said body will be flexed in one direction when said outer end of said nut is in said outward location,
said second thrust-bearing means being positioned to create tension in said truss rod and flexing of said body in the other direction when said nut is in forcible engagement with said second thrust-bearing means, and
(f) means to conceal said first and second thrust-bearing means.

7. The invention as stated in claim 6, in which said nut incorporates at the outer end thereof a means to effect nonrotatable engagement of said nut by a tool located coaxially of said nut.

8. The invention as claimed in claim 6, in which a topnut is permanently mounted on said neck body, and in which one of said thrust-bearing means is a stop plate disposed beneath said topnut and concealed thereby.

9. The invention as claimed in claim 6, in which face dots are provided on the upper side of said neck body, and in which said means to anchor said sleeve is disposed beneath and concealed by one of said face dots.

10. A guitar neck, which comprises:
(a) an elongated neck body,
(b) a topnut mounted at the outer end of said neck body,
(c) a bowed truss rod mounted in said body,
the outer end of said truss rod being threaded,
(d) an elongated nut mounted coaxially on said threaded outer end, and extending axially-outwardly therefrom,
(e) a stop plate mounted in said body beneath said topnut outwardly of said nut, and covered and concealed by said topnut,
said stop plate being disposed to be engaged by said nut to compress said truss rod longitudinally and thus change the degree of bowing of said truss rod, said stop plate being apertured, and
(f) means on the outer end of said nut adapted to be nonrotatably engaged by an element oriented axially of said nut and passed through the aperture in said stop plate.

11. The invention as claimed in claim 10, in which said neck further comprises an anchor element associated with a central region of said truss rod, means to secure said anchor element to said neck body, and a face dot mounted over a part of said last-named means to cover and conceal the same, said face dot being located in a conventional face-dot position to aid a guitarist in playing the guitar on which said neck is employed.

12. A guitar neck, comprising:
(a) a neck body formed of wood,
(b) a single truss rod mounted in said body and lying in a plane which is perpendicular to the upper side of said body and contains the longitudinal axis of said body,
said truss rod being bowed,
the central region of said truss rod being relatively remote from said upper side,
the ends of said truss rod being relatively adjacent said upper side,
at least one of said truss rod ends being threaded,
(c) means to lock the other of said truss rod ends to said wooden neck body to prevent longitudinal and rotational movement of such other end relative to said body,
(d) an elongated nut threaded coaxially onto said one end of said truss rod in partially-telescoped relationship relative to said one end,
said nut and said one end of said truss rod being disposed at an angle to a plane containing the axis of said neck and generally parallel to the fingerboard,
said angle being such that said truss rod curves continuously from said one end thereof to at least the central region thereof,
(e) first thrust-bearing means provided in said wooden neck body adjacent the outer end of said nut, said first thrust-bearing means being spaced farther from said other of said truss rod ends than is the extreme tip of said one truss rod end, (f) second thrust-bearing means provided in said wooden neck body adjacent the inner end of said nut, whereby said nut is confined against substantial axial movement by said first and second thrust-bearing means, so that rotation of said nut in opposite directions effects longitudinal shifting of said one truss rod end to increase or decrease the amount of bowing of said truss rod, (g) means on said neck to conceal said first and second thrust-bearing means, (h) means on the outer end of said nut adapted to be nonrotatably engaged by an adjustment means, and (i) means to associate at least the central region of said truss rod with said body and translate said increased or decreased bowing of said truss rod into downward or upward bowing of said body.

13. The invention as claimed in claim 12, in which said means (h) comprises a noncircular opening in the outer end of said nut, said opening being adapted to receive nonrotatably a wrench, in which said first thrust-bearing means has an opening therethrough adapted to rotatably receive a wrench, and in which said body has an opening therethrough adapted to rotatably receive a wrench, whereby a wrench may be inserted through said body, said first thrust-bearing means and into said non-circular opening to thus rotate said nut about the axis thereof, said wrench then being generally coaxial with said nut.

14. The invention as claimed in claim 12, in which said means (i) to associate at least the central region of said truss rod with said body comprises an anchor sleeve mounted slidably on the central region of said truss rod, and further comprises means to anchor said sleeve to said neck body at a region between said sleeve and the upper side of said neck body.

15. The invention as claimed in claim 14, in which said last-named means comprises a shank extended upwardly through a bore in said neck body, and a screw threaded downwardly into said shank, the head of said screw being seated in said neck body below the upper surface thereof.

16. The invention as claimed in claim 12, in which said other of said truss rod ends is disposed relatively adjacent the end of said neck which connects to the guitar body, in which the underside of said neck body has a truss rod groove which receives said truss rod and is adapted to receive a wooden insert below said truss rod, in which a relatively small-diameter inclined bore is extended from said groove through said body toward the region where the upper side of said neck body merges with the upper side of the peghead connected thereto, in which a relatively large-diameter inclined bore is provided in said neck body coaxial to said relatively small-diameter bore and on the side of said small-diameter bore relatively adjacent to said region of merger, in which said truss rod extends through said small-diameter bore and into said large-diameter bore, in which said elongated nut is mounted rotatably in said large-diameter bore, in which the inner end of said nut seats adjacent the shoulder between said large and small-diameter bores, said shoulder forming at least part of said second thrust-bearing means, in which said nut, when seated on said second thrust-bearing means, is entirely on one side of a plane perpendicular to the axis of the guitar neck and intersecting the region of the upper surface of the guitar neck where the topnut is to be mounted, in which said first thrust-bearing means is a stop plate disposed in a recess communicating with and directly below said topnut-mounting region, said stop plate being apertured to permit rotation of said nut, and in which a topnut is permanently mounted on said region over said stop plate and conceals said stop plate.

17. The invention as claimed in claim 16, in which a bored dowel is mounted in said region where the upper surface of said neck body merges with the upper surface of the peghead, the bore and said dowel registering with the aperture in said stop plate and also with said means (h).

* * * * *

UNITED STATES PATENT AND TRADEMARK OFFICE

CERTIFICATE OF CORRECTION

PATENT NO. : 4,557,174

DATED : December 10, 1985

INVENTOR(S) : Charles A. Gressett, Jr.

It is certified that error appears in the above-identified patent and that said Letters Patent is hereby corrected as shown below:

Claim 2, line 40, column 6, after the word "to", the word ---conceal--- should have been inserted.

Signed and Sealed this

*Seventeenth* Day of *June 1986*

[SEAL]

*Attest:*

DONALD J. QUIGG

*Attesting Officer*

*Commissioner of Patents and Trademarks*